US009964282B2

(12) United States Patent
Yamada et al.

(10) Patent No.: US 9,964,282 B2
(45) Date of Patent: May 8, 2018

(54) ILLUMINATION DEVICE

(71) Applicant: MINEBEA MITSUMI INC., Kitasaku-gun, Nagano (JP)

(72) Inventors: Akari Yamada, Fukuroi (JP); Reishi Shimaoka, Kakegawa (JP)

(73) Assignee: MINEBEA MITSUMI INC., Nagano (JP)

( * ) Notice: Subject to any disclaimer, the term of this patent is extended or adjusted under 35 U.S.C. 154(b) by 0 days. days.

(21) Appl. No.: 15/262,375

(22) Filed: Sep. 12, 2016

(65) Prior Publication Data

US 2017/0082261 A1 Mar. 23, 2017

(30) Foreign Application Priority Data

Sep. 18, 2015 (JP) ..... 2015-185266

(51) Int. Cl.

| | |
|---|---|
| ***F21V 5/00*** | (2018.01) |
| ***F21V 13/04*** | (2006.01) |
| ***F21V 5/04*** | (2006.01) |
| ***F21V 23/00*** | (2015.01) |
| ***F21V 7/00*** | (2006.01) |
| *F21Y 115/10* | (2016.01) |

(52) U.S. Cl.

CPC ..... *F21V 5/008* (2013.01); *F21V 5/005* (2013.01); *F21V 5/045* (2013.01); *F21V 7/0091* (2013.01); *F21V 13/04* (2013.01); *F21V 23/005* (2013.01); *F21Y 2115/10* (2016.08)

(58) Field of Classification Search

CPC ..... F21V 5/008; F21V 5/045; F21V 5/005; F21V 7/0091; F21V 23/005; F21V 13/04; F21Y 2115/10

See application file for complete search history.

(56) References Cited

U.S. PATENT DOCUMENTS

| | | | |
|---|---|---|---|
| 2008/0204901 | A1 | 8/2008 | Amano et al. |
| 2010/0284194 | A1 | 11/2010 | Miyashita et al. |

FOREIGN PATENT DOCUMENTS

| | | | | |
|---|---|---|---|---|
| JP | 2007-079082 | A | | 3/2007 |
| JP | 2011-113798 | A | | 6/2011 |
| JP | 2011-141450 | A | | 7/2011 |
| JP | 2011141450 | A | * | 7/2011 |
| JP | 2013-105942 | A | | 5/2013 |
| JP | 2014-142998 | A | | 8/2014 |
| WO | 2012/063759 | A1 | | 5/2012 |

OTHER PUBLICATIONS

Notification of Reasons for Refusal dated Jan. 23, 2018 for corresponding Japanese Application No. 2015-185266.

* cited by examiner

*Primary Examiner* — David V Bruce
(74) *Attorney, Agent, or Firm* — Pearne & Gordon LLP

(57) ABSTRACT

An illumination device according to an embodiment includes a light emitting element, a light distribution control unit and a light diffuser. The light distribution control unit is arranged at an emission direction side of light of the light emitting element. The light diffuser is arranged at an advancing direction side of the light relative to the light distribution control unit, in which each of a plurality of rows of convex portions having biaxial anisotropy in a plan view extends in a predetermined anisotropic axis direction, in which the plurality of rows is arranged orthogonal to the predetermined anisotropic axis and has grooves of irregular depths between the arranged plurality of rows of the convex portions.

9 Claims, 6 Drawing Sheets

ILLUMINATION DEVICE

CROSS-REFERENCE TO RELATED APPLICATION(S)

The present application claims priority to and incorporates by reference the entire contents of Japanese Patent Application No. 2015-185266 filed in Japan on Sep. 18, 2015.

BACKGROUND OF THE INVENTION

1. Field of the Invention

The present invention relates to an illumination device using a light emitting element, such as an LED light source.

2. Description of the Related Art

Illumination devices using LED light sources are used in various situations. As for illumination devices used in stores (in particular, luxury brand stores), excellence in design is required in addition to optical properties and electrical properties.

As for illumination devices used in showcases and the like, a plurality of light sources is aligned side by side in one direction. This type of illumination device is also called a line illumination device. For line illumination devices, thickness, compactness and no appearance of hot spots on light emitting surface are of importance. The appearance of hot spots herein refers to the state in which the light emitting surface is seen with high luminance in the form of spots at positions where the LED light sources are located and the luminance of the light emitting surface becomes non-uniform.

As for conventional line illumination devices, there are many products in which only a diffuser plate is disposed immediately above the LED light sources. Increasing the LED to diffuser plate distance or using a diffuses plate with a high haze value, in addition to lining up surface mount device (SMD) type light sources without gaps thereamong, for example, is one way of solving the problem of the appearance of hot spots fey using only the diffuses plate. However, the former case has the problem that thickness of the device is increased, and the latter case has the problem that the energy efficiency is reduced and sufficient brightness cannot be obtained.

Further, a diffuser plate only is not sufficient to perform light distribution control of light emitted from the LED light sources, in which case light is spread out too broad and regions other than the merchandise are irradiated with the light; and thus, not only is the energy efficiency low, but also it is not suitable for making the merchandise stand out to consumers. In Japanese Patent Application Laid-open No. 2011-141450, Japanese Patent Application Laid-open No. 2011-113798, and International Publication Pamphlet No. WO 2012/063759, for example, illumination devices have bean disclosed, in which a Fresnel lens or a prism sheet is used as a light distribution control member in order to perform light distribution control for light emitted from LED light sources.

An illumination device which can emit illumination light of higher quality is required in order to achieve illumination of higher quality. However, as for the conventional techniques, color non-uniformity may be generated in the illumination light. In realization of illumination light of higher quality, it is required that this be overcome.

SUMMARY OF THE INVENTION

It is an object of the present invention to at least partially solve the problems in the conventional technology.

An illumination device according to an embodiment includes a light emitting a light distribution control unit and a light diffuser. The light distribution control unit is arranged at an emission direction side of light of the light emitting element. The light diffuser is arranged at an advancing direction side of the light relative to the light distribution control unit, in which each of a plurality of rows of convex portions having biaxial anisotropy in a plan view extends in a predetermined anisotropic axis direction, in which the plurality of rows is arranged orthogonal to the predetermined anisotropic axis and has grooves of irregular depths between the arranged plurality of rows of the convex portions.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of an illumination device according to the present invention will be described in detail with reference to the drawings. The present invention is not limited to these embodiments. Further, in the respective drawings, the same signs are appended, as appropriate, to the same or corresponding elements.

First Embodiment

Figure 1A:
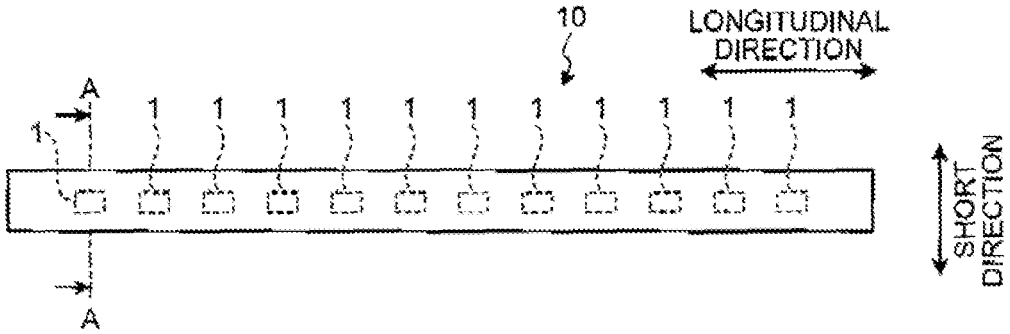
FIGS. 1A and 1B are schematic diagrams of an illumination device according to a first embodiment.
Figure 1B:
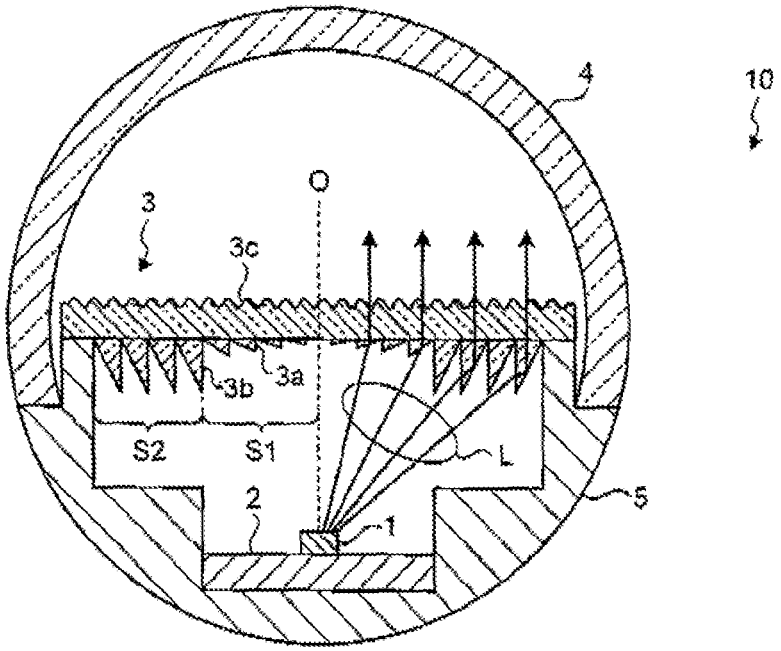

FIGS. 1A and 1B are schematic diagrams of an illumination device according to a first embodiment of the present invention. FIG. 1A is a top view, and FIG. 1B is an A-A line cross sectional diagram of FIG. 1A.

As illustrated in FIG. 1A, this illumination device 10 is a line illumination device, having a configuration in which a plurality of light emitting elements 1 is arranged by being lined up in one direction. The direction in which the plurality of light emitting elements 1 is lined up will be referred to as "longitudinal direction" of the illumination device 10, and a direction orthogonal to the longitudinal direction will be referred to as "short direction".

As illustrated in FIG. 1B, the illumination device 10 includes the light emitting elements 1, a substrate 2, an optical member 3, a cover 4, and a base 5.

Each of the light emitting elements 1 includes an LED chip that radially emits blue light, and a sealing material that seals the LED chip and is formed of a translucent resin material. The sealing material has a fluorescent material (for example, YAG:Ce microparticles) dispersed therein, the fluorescent material absorbing blue light and emitting light in yellow that is a complementary color of blue. Thereby, the light emitting element 1 is formed as a white LED element. Illumination light emitted from the light emitting elements 1 is isotropic with respect to the central axis O and has a substantially circular shape as viewed from an upper side thereof.

The substrate 2 has a shape extending in the longitudinal direction, and is a circuit board on which the plurality of light emitting elements 1 are mounted. The substrata 2 includes en external connection wiring (not illustrated) for supplying drive power, control signals, and the like, to the light emitting elements 1 from outside.

The optical member 3 has a shape extending in the longitudinal direction, and is arranged at an emission direction side of light of the light emitting elements 1. Details of the optical member 3 will be described later.

The cover 4 has a shape formed by a part of a cylindrical tube extending in the longitudinal direction being notched along the longitudinal direction, and the cover 4 is arranged to cover the optical member 3. The cover 4 is formed of a milky white material (for example, resin) that diffuses light.

The base 5 has a shape extending in the longitudinal direction, and is configured to support the substrate 2, the optical member 3, and the cover 4.

Next, the optical member 3 will be described. The optical member 3 is formed of, for example, a transparent optical material (for example, resin). The optical member 3 has a flat plate shape extending in the longitudinal direction, and is arranged such that a central line thereof substantially matches the central axis O of light emission of the respective light emitting elements 1 and the central axis O and a principal surface of the plate are orthogonal to each other. The optical member 3 includes a plurality of prisms 3*a* and 3*b* forming a light distribution control unit. The prisms 3*a* and 3*b* are provided on the principal surface of the optical member 3, the principal surface at the light emitting element 1 side, so as to extend in the longitudinal direction. That is, the light distribution control unit formed of the prisms 3*a* and 3*b* is arranged at the emission direction side of the light of the light emitting elements 1.

The prism 3*a* is line symmetrically provided with respect to the central axis O in a region S1 at an inner side. The prism 3*b* is line symmetrically provided with respect to the central axis O in a region S2 outside the region S1. The prisms 3*a* and 3*b* are configured as a linear Fresnel lens (an example of a Fresnel lens), which is a total internal reflection (TIR) prism with the prism 3*a* being a refractive prism and the prism 3*b* being a total reflection prism.

Thereby, as illustrated in FIG. 1B, light distribution of white light L radially emitted from the light emitting elements 1 is controlled such that inclination angle of the white light L with respect to the central axis O is reduced, by the white light L being refracted by the prism 3*a* and being totally reflected internally by the prism 3*b*. Therefore, spread of the white light L is made narrower in the short direction, toy the plurality of prisms 3*a* and 3*b* forming the light distribution control unit. In the figure, the light distribution of the white light L is controlled such that an advancing direction of the white light L becomes parallel to the central axis O, but the advancing direction of the white light L is not limited to being parallel to the central axis O, as long as the light distribution is controlled such that the inclination angle with respect to the central axis O is made smaller than that in a case without the prisms 3*a* and 3*b*.

Further, the optical member 3 includes a light diffuser 3*c*, The light diffuses 3*c* is provided on the entire surface of a principal surface of the optical member 3, the principal surface opposite to that at the light emitting element 1 side. That is, the light diffuser 3*c* is arranged at the advancing direction side of light (white light L), relative to the light distribution control unit.

Figure 2:
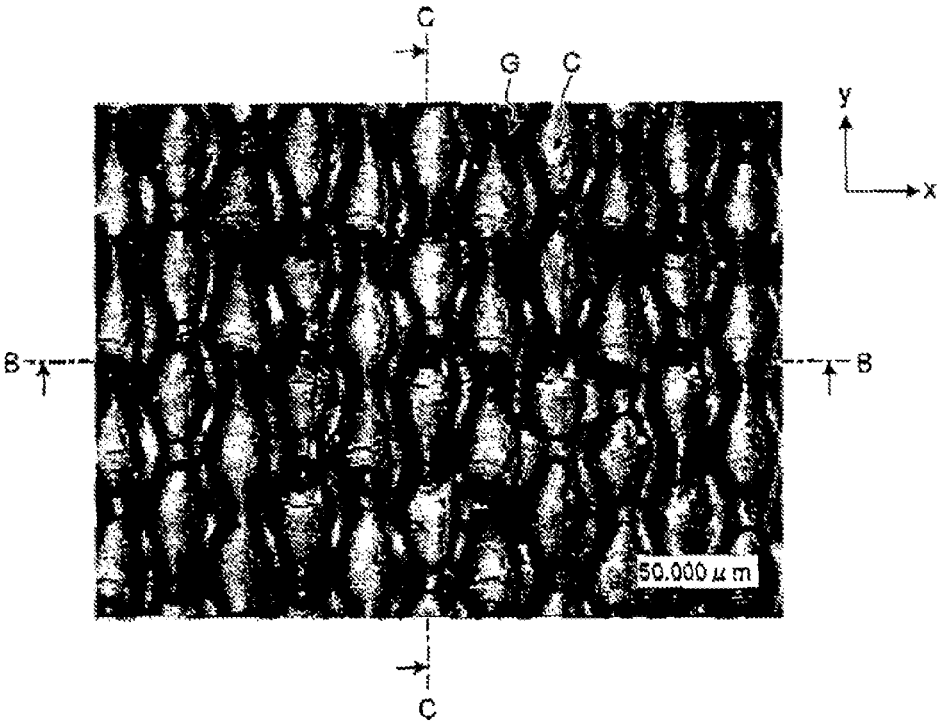
FIG. 2 is a schematic diagram illustrating a micrograph capturing a light diffuser illustrated in FIGS. 1A and 1B from an upper surface side thereof.

The light diffuser 3*c* will now be described. FIG. 2 is a schematic diagram illustrating a micrograph capturing the light diffuser 3*c* from an upper surface side thereof. For explanation, an x-axis and a y-axis orthogonally intersecting each other as illustrated in FIG. 2 will be defined. As illustrated in FIG. 2, the light diffuser 3*c* has: a row of convex portions C, each of which has a substantially elliptical shape in a plan view thereof, the row extending in a major-axis direction (y-axis direction) of the ellipse; a plurality of these rows arranged in a minor-axis direction (x-axis direction) of the ellipse; and grooves G of irregular depths which are arranged between the rows of the convex portions C.

Figure 3:
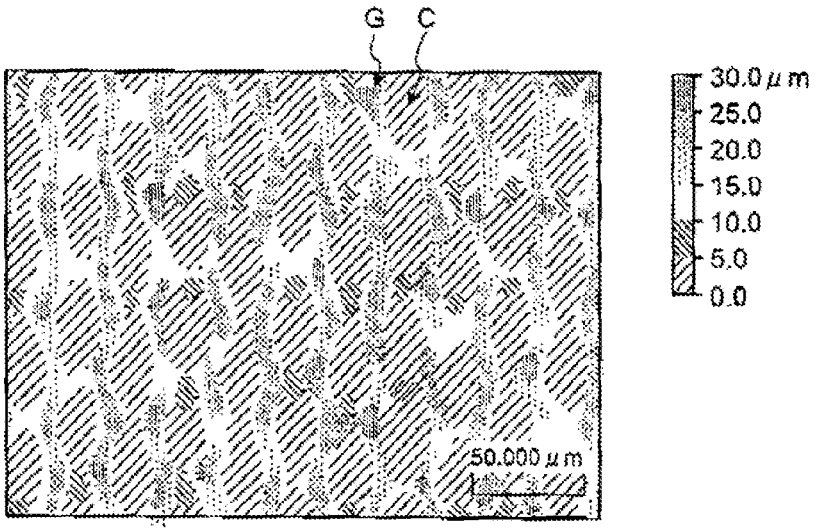
FIG. 3 is a schematic diagram illustrating height difference of the light diffuser illustrated in FIGS. 1A and 1B.
Figure 4A:
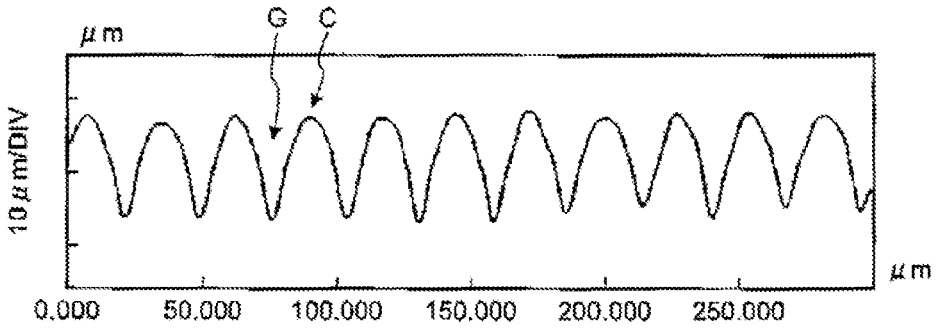
FIGS. 4A and 4B are diagrams illustrating a B-B line cross section and a C-C line cross section, of FIG. 2.
Figure 4B:
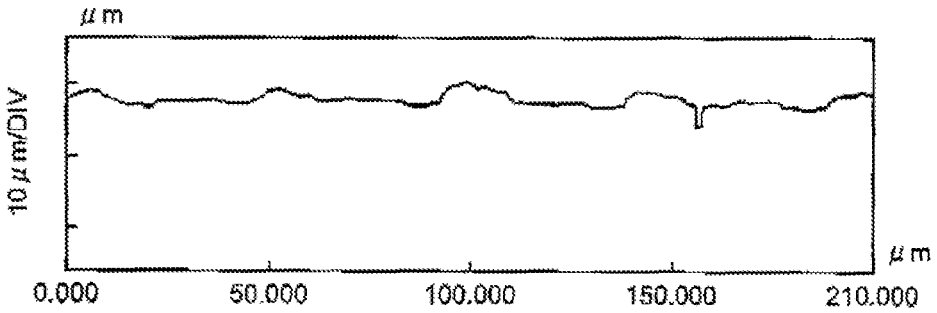

FIG. 3 is a schematic diagram illustrating height difference of the light diffuses 3*c*. FIGS. 4A and 4B are diagrams illustrating a B-B line cross section and a C-C line cross section of FIG. 2. FIG. 2 and FIG. 3 illustrate substantially the same region on the principal surface where the light diffuses 3*c* is provided. Further, in FIG. 3, distance (depth) from a height of a vertex of the convex portion C, the height being a reference, to a surface of the light diffuser 3*c*, is illustrated with different patterns according to the depth between 0 μm to 30.0 μm.

As illustrated in FIG. 3 to FIG. 4B, an average height from the grooves G to the vertex of the convex portion C is about 15 μm, and depth of the grooves G irregularly varies in a range of about 5 μm. That is, the depth of the grooves G irregularly varies in a range of about ⅓ of the average height from the grooves G to the vertex of the convex portion C.

The light diffuser 3*c* is provided in the optical member 3, such that the major axis direction (y-axis direction) of the convex portions C is the short direction of the illumination device 10, that is, the extending direction of the prisms 3*a* and 3*b* orthogonally intersects the major-axis direction of the convex portions C. Thereby, the light diffuser 3*c* provides an effect of diffusing, in the longitudinal direction, the white light L, with its light distribution having been controlled by the light distribution control unit. As a result, this illumination device 10 can realize ideal light distribution control of diffusing the white light L in the longitudinal direction in a state where the diffusion (spread) in the short direction has been reduced. Therefore, appearance of hot spots can be efficiently reduced and uniformity of the light emitting surface can be improved.

Further, this illumination device 10 can realize: a fine mixing effect of light to be achieved by the effect of the grooves G of the light diffuser 3*c*, the grooves G having irregular depth; color unevenness (chromaticity difference) at an irradiation surface to be reduced; and uniformity to be improved.

The above described light diffuser 3*c*, in which the row of convex portions C each having a semi-ellipsoidal shape extends in the major-axis direction of the approximate ellipse, in which the plurality of these rows are arranged in the minor-axis direction of the ellipse end which have the groove G between the rows of the convex portions C, the groove G having irregular depth, can be manufactured as described below. First of all, a metal mold is manufactured by performing laser beam machining, by irradiating a surface of a metal mold member with laser light having an elliptical beam shape. One concave portion (a shape to be a mold of the convex portion C) that is substantially elliptical is formed by irradiating one position on the metal mold member with the laser light, and a row of the concave portions is formed by carrying out this formation by shifting the irradiation position of the laser light little by little. By molding an optical member by use of this metal mold, the light diffuser 3*c* can be manufactured. The shape of the convex portion C (concave portion) can be made into a desired shape by adjusting, as appropriate, irradiation conditions, such as intensity of the laser light to be emitted to the metal mold member or the number of irradiations per position.

First Embodiment

As a first embodiment of the present invention, a line illumination device was manufactured according to the first embodiment. In a state where a cover has been removed, electric power was supplied to the line illumination device of the first embodiment to cause light emission, and spread angles of illumination light in a longitudinal direction and a short direction thereof were measured.

Figure 5:
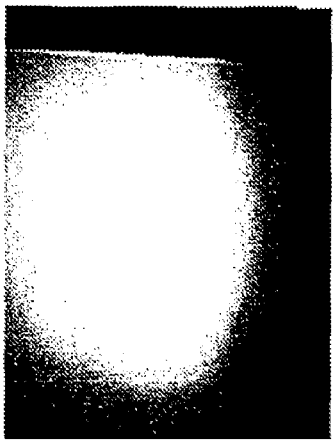
FIG. 5 is a diagram illustrating how illumination light emitted from a line illumination device of a first embodiment is emitted towards a well surface.

FIG. 5 is a diagram illustrating how the illumination light emitted from the line illumination device of the first embodiment was emitted towards a wall surface. As illustrated in FIG. 5, the illumination light emitted in a circular shape from the light emitting elements 1 is distributed in an elliptical shape without color non-uniformity. The measured spread angles of the illumination light were 72 degrees in the longitudinal direction and 48 degrees in the short direction. As described above, the line illumination device of the first embodiment can realist ideal light distribution control achieving diffusion in the longitudinal direction in a state where the diffusion in the short direction has been reduced. Further, since the spread angle of the illumination light in the longitudinal direction was wide, appearance of hot spots was suppressed and a light emitting surface with substantially uniform luminance can be obtained.

Second Embodiment

Figure 6A:
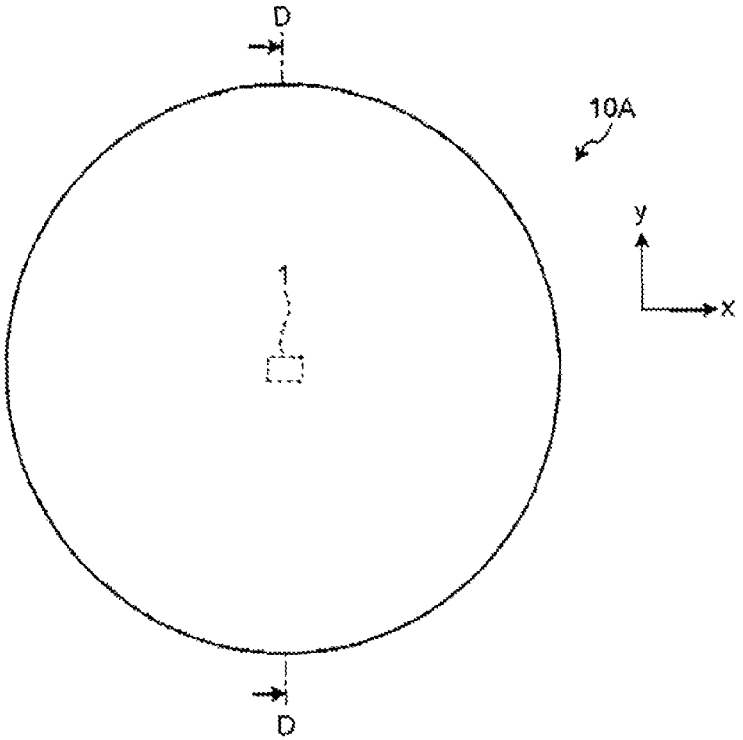
FIGS. 6A and 6B are schematic diagrams of an illumination device according to a second embodiment.
Figure 6B:
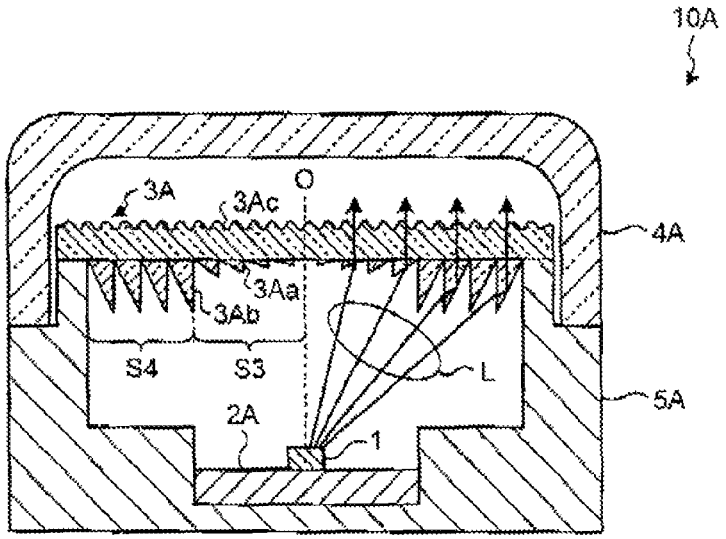

FIGS. 6A and 6B are schematic diagram of an illumination device according to a second embodiment of the present invention. FIG. 6A is a top view, and FIG. 6B is a D-D line cross sectional diagram of FIG. 2(*a*).

As illustrated in FIG. 6A, this illumination device 10A is an illumination device, having one light emitting element 1 around a center thereof. As illustrated in FIG. 6B, the illumination device 10A includes the light emitting element 1, a substrate 2A, an optical member 3A, a cover 4A, and a base 5A. Since the light emitting element 1 is the same as the light emitting element 1 of the first embodiment, description thereof will be omitted.

The substrate 2A has a discoidal shape, and is a circuit board on which the single light emitting element 1 is mounted. The substrate 2A includes an external connection wiring (not illustrated) for supplying drive power, control signals, and the like, to the light emitting element from outside.

The optical member 3A has a discoidal shape, and is arranged at an emission direction side of light of the light emitting element 1. Details of the optical member 3A will be described later.

The cover 4A has a cylindrical lid-like shape, and is arranged to cover the optical member 3A. The cover 4A is, for example, formed of a milky white material (for example, resin) that diffuses light.

The base 5A has an external form with a cylindrical shape, and is configured to support the substrate 2A, the optical member 3A, and the cover 4A.

Next, the optical member 3A will be described. The optical member 3A is forced of, for example, a transparent optical material (for example, resin). The optical member 3A is disc-shaped, and is arranged such that: a central axis thereof substantially matches the central axis O of the light emission of the light emitting element 1; and the central axis O and a principal surface of the disc are orthogonal to each other. The optical member 3A includes a plurality of prisms 3Aa and 3Ab forming a light distribution control unit. The prisms 3Aa and 3Ab are concentrically provided around the central axis O on a principal surface of the optical member 3A, the principal surface at the light emitting element 1 side. That is, the light distribution control unit formed of the prisms 3Aa and 3Ab is arranged at the emission direction side of the light of the light emitting element 1.

The prism 3Aa is concentrically provided around the central axis Q in a region S3 at an inner side and is ring-shaped. The prism 3Ab is concentrically provided around the central axis O in a region S4 around the region S3, and is ring-shaped. The prisms 3Aa and 3Ab are configured as a Fresnel lens, which is a TIR prism with the prism 3Aa being a refractive prism and the prism 3Ab being a total reflection prism.

Thereby, as illustrated in FIG. 6B, light distribution of white light L radially emitted from the light emitting element 1 is controlled such that inclination angle of the white light L with respect to the central axis O is reduced, by the white light L being refracted by the prism 3Aa and being totally reflected internally by the prism 3Ab.

Further the optical member 3A includes a light diffuser 3Ac. The light diffuser 3Ac is provided on the entire surface of a principal surface of the optical member 3A, the principal surface opposite to that at the light emitting element 1 side. That is, the light diffuser 3Ac is arranged at an advancing direction side of the light (white light L), in contrast with the light distribution control unit.

The light diffuser 3Ac has a shape similar to that of the light diffuser 3*c* of the first embodiment. That is, a row of convex portions that are substantially elliptical in a plan view thereof extends in a major-axis direction of the ellipse, a plurality of these rows are arranged in a minor-axis direction of the ellipse, and the light diffuser 3Ac has grooves with irregular depths between the rows of the convex portions. Thereby, this illumination device 10A can realize ideal light distribution control of diffusing the white light L in only a predetermined direction on a surface perpendicular to the central axis O.

Further, this illumination device 10A can realize: a fine mixing effect of light to be achieved by the effect of the grooves of the light diffuser 3Ac, the grooves having irregular depths; color non-uniformity (chromaticity difference) at an irradiation surface to be reduced and uniformity to be improved.

Second Embodiment and Comparative Example

As a second embodiment of the present invention, a line illumination device was manufactured according to the above described second embodiment. Further, as a comparative example, an illumination device was manufactured, which had the same configuration as the first embodiment, except that the principal surface provided with the light diffuser in the first embodiment had been made into a mirror surface without the provision of the light diffuser. In a state where a cover has been removed, electric power was supplied to the illumination devices of the second embodiment and the comparative example to cause light emission, and angular distributions of illuminance of illumination light in two orthogonally intersecting directions on a surface perpendicular to an optical axis ware measured. The two orthogonally intersecting directions in the second embodiment were a minor-axis direction (the x-axis direction in FIG. 2) and a major axis direction (the y-axis direction in FIG. 2), of a semi-ellipsoid in the optical diffuser. On the contrary, in the comparative example, since the optical diffuser is not provided, two arbitrary directions orthogonally intersecting each other were defined as the x-axis direction and y-axis direction.

Figure 7A:
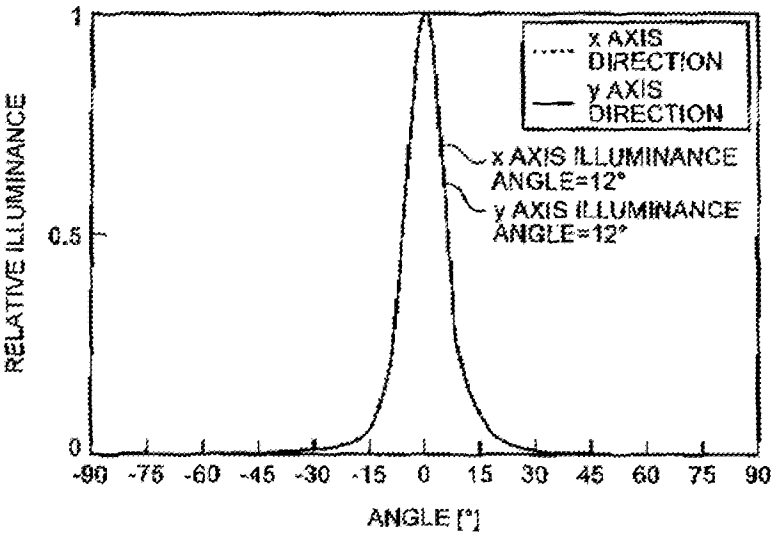
FIGS. 7A and 7B are diagrams illustrating angular distributions of illuminance in illumination devices of a comparative example and a second embodiment.
Figure 7B:
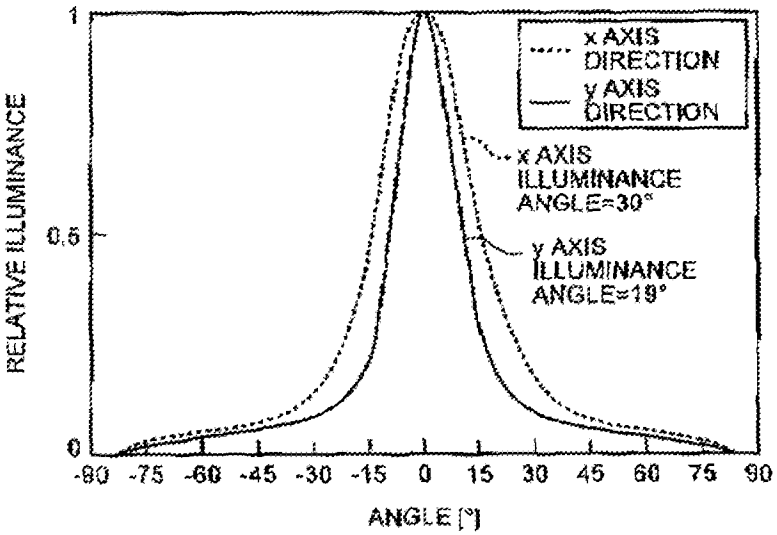

FIGS. 7A and 7B are diagrams illustrating the angular distributions of the illuminance in the illumination devices of the comparative example (FIG. 7A) and the second embodiment (FIG. 7B). As illustrated in FIG. 7A, while in the comparative example, the illuminance angles in both the x-axis direction and y-axis direction were 12 degrees; as illustrated in FIG. 7B, in the second embodiments the illuminance angles were 30 degrees in the x-axis direction and 19 degrees in the y-axis direction; and thus it has been confirmed that circular irradiation light can be made into an elliptical shape by controlling light distribution with anisotropy of the light diffuser.

Next, angular distributions of chromaticity of illumination light of the second embodiment and the comparative example were respectively measured in the x-axis direction and y-axis direction.

Figure 8A:
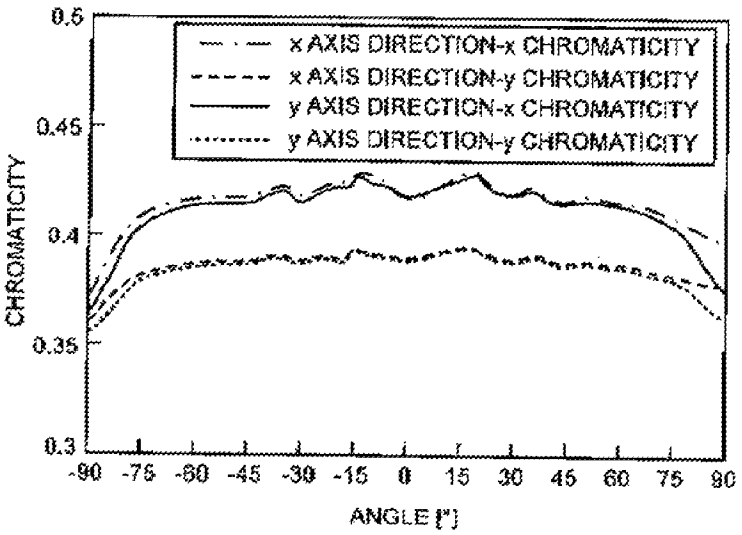
FIGS. 8A and 8B are diagrams illustrating angular distributions of chromaticity in the illumination devices of the comparative example and the second embodiment.
Figure 8B:
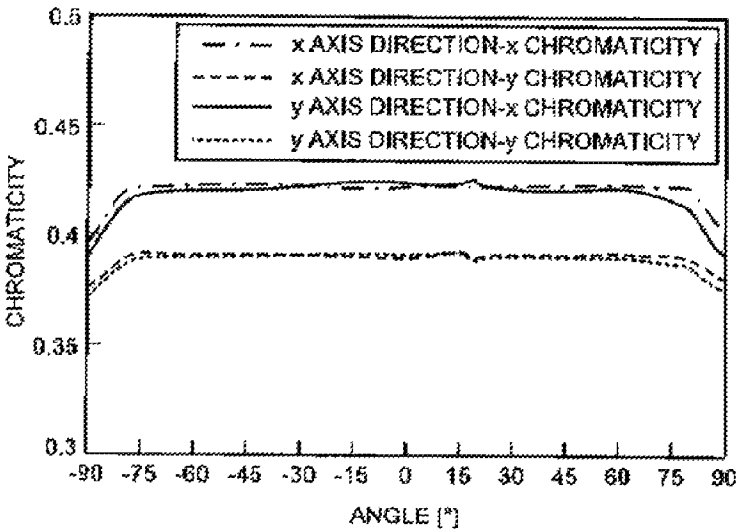

FIGS. 8A and 8B are diagrams illustrating the angular distributions of the chromaticity in the illumination devices of the comparative example (FIG. 8A) and the second embodiment (FIG. 8B). As illustrated in FIG. 8A, the comparative example has: difference depending on angle for both the x-chromaticity and y-chromaticity; graph shapes with irregular convenes and concaves; and color non-uniformity. On the contrary, as illustrated in FIG. 8B, in the second embodiment, difference depending on angle was small for both the x-chromaticity and y-chromaticity, shapes of the graphs were smooth, and color non-uniformity was reduced.

As described above, according to these first and second embodiments, more ideal light distribution control is possible, and color non-uniformity of illumination light is reduced.

In the above described embodiments, although the convex portions of the light diffusers are substantially elliptical, the shape of the convex portion is not necessarily elliptical, and may be, for example, cuboidal, cylindrical, or spindle shaped, as long as the shape in a plan view thereof has biaxial anisotropy.

Further, in the above described embodiments, although the light distribution control unit is formed of the Fresnel lens, not being limited to the Fresnel lens, the light distribution control unit may be formed of an ordinary lens. Furthermore, even if the light distribution control unit is formed of a Fresnel lens, a structure thereof is not limited to the combination of the refractive prism and the total reflection prism.

Moreover, although in the above described embodiments, the light emitting element is a white LED element, the white LED element is not limited to the one of the type, in which a yellow fluorescent body is applied to the blue LED chip. In addition, the light emitting element may be an LED element of a red color, green color, blue color, or the like, not being limited to the white LED element.

What is more, in the above described embodiments, although the light distribution control unit and the light diffuser are provided in the same optical member, the light distribution control unit and the light diffuser may be provided on separate optical members. Further, only the light diffuser may be included, without the light distribution control unit.

According to the present invention, by use of the light distribution control unit and the light diffuser, an effect of enabling more ideal light distribution control and reducing color unevenness with the light diffuser can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An illumination device, comprising:

a light emitting element;

a light distribution control unit arranged at an emission direction side of light of the light emitting element; and a light diffuser which is arranged at an advancing direction side of the light relative to the light distribution control unit, wherein the light diffuser has a plurality of rows of convex portions, each convex portion has biaxial anisotropy in a plan view, the plurality of rows of convex portions extends in a predetermined anisotropic axis direction, the plurality of rows is arranged orthogonal to the predetermined anisotropic axis and the light diffuser has grooves of irregular depths between the arranged plurality of rows of the convex portions.

2. The illumination device according to claim 1, wherein in the light diffuser, the plurality of rows of convex portions are substantially ellipses, the plurality of rows of the convex portions extends in a major-axis direction of the ellipses, and the plurality of rows is arranged in a minor-axis direction of the ellipses.

3. The illumination device according to claim 2, further comprising:

a plurality of the light emitting elements, wherein the plurality of the light emitting elements is arranged by being lined up in a predetermined direction, and the light diffuser is arranged such that the major-axis direction of the ellipses is orthogonal to the predetermined direction.

4. The illumination device according to claim 3, wherein the light distribution control unit extends in the predetermined direction, and is formed of a Fresnel lens including a plurality of prisms extending in the predetermined direction.

5. The illumination device according to claim 1, wherein the light emitting element is singly provided, and the light distribution control unit is formed of a Fresnel lens including a plurality of ring-shaped prisms concentrically arranged around the single light emitting element.

6. The illumination device according to claim 4, wherein the Fresnel lens includes a refractive prism and a total reflection prism.

7. The illumination device according to claim 1, wherein the light distribution control unit and the light diffuser are provided in a same optical member.

8. An illumination device, comprising:

a plurality of light emitting elements arranged by being lined up in one direction;

a light distribution control unit arranged at an emission direction side of light of the plurality of light emitting elements; and a light diffuser which is arranged at an advancing direction side of the light relative to the light distribution control unit, wherein the light diffuser has a plurality of rows of convex portions, each convex portion has biaxial anisotropy in a plan view, the plurality of rows of convex portions extends in a major-axis direction, the plurality of rows is arranged orthogonal to the major-axis and the major-axis direction is orthogonal to the one direction.

9. The illumination device according to claim 8, wherein the light distribution control unit extends in the one direction and is formed of a Fresnel lens including a plurality of prisms extending in the one direction.

* * * * *